US009174761B1

(12) United States Patent
Grist

(10) Patent No.: US 9,174,761 B1
(45) Date of Patent: Nov. 3, 2015

(54) PRE-FABRICATED TEMPLATES TO CONSTRUCT VARIABLE-DIMENSIONED CONTAINERS

(75) Inventor: Elizabeth A. Grist, Baltimore, MD (US)

(73) Assignee: T.E. Brangs, Inc., Baltimore, MD (US)

( * ) Notice: Subject to any disclaimer, the term of this patent is extended or adjusted under 35 U.S.C. 154(b) by 313 days.

(21) Appl. No.: 13/471,433

(22) Filed: May 14, 2012

Related U.S. Application Data

(60) Provisional application No. 61/485,823, filed on May 13, 2011.

(51) Int. Cl.
*B65D 5/54* (2006.01)
*B65D 5/22* (2006.01)

(52) U.S. Cl.
CPC ..... *B65D 5/22* (2013.01)

(58) Field of Classification Search
CPC ..... B65D 5/22; B65D 5/4266
USPC ..... 229/101, 101.1, 101.2, 103; 206/736
See application file for complete search history.

(56) References Cited

U.S. PATENT DOCUMENTS

| | | | | |
|---|---|---|---|---|
| 3,313,467 | A | | 4/1967 | Anderskow et al. |
| 3,598,303 | A | | 8/1971 | Folz |
| 3,727,827 | A | | 4/1973 | Stice et al. |
| 4,136,817 | A | | 1/1979 | Perry et al. |
| 4,452,367 | A | | 6/1984 | Wein |
| 4,511,079 | A | | 4/1985 | Lopez |
| 4,763,831 | A | | 8/1988 | Huang et al. |
| 5,060,849 | A | | 10/1991 | King |
| 5,693,384 | A | * | 12/1997 | Hollinger, Jr. ..... 428/34.2 |
| 6,138,901 | A | | 10/2000 | Kim et al. |
| 6,279,818 | B1 | | 8/2001 | Kim et al. |
| 6,364,199 | B1 | | 4/2002 | Rose |
| 6,394,336 | B1 | | 5/2002 | Beneroff et al. |
| 6,676,009 | B1 | | 1/2004 | Rose |
| 7,070,089 | B2 | | 7/2006 | Kim et al. |
| 7,455,214 | B2 | | 11/2008 | Miller et al. |

FOREIGN PATENT DOCUMENTS

EP 97022 A1 * 12/1983 ..... B65D 5/42

OTHER PUBLICATIONS

"MWare for Folded Take Out Containers", (2010), 4 pages.
"MWV Offers Klafold A Paperboard Manufactured by Klabin", (2008), 4 pages.

* cited by examiner

*Primary Examiner* — Christopher Demeree
(74) *Attorney, Agent, or Firm* — Garrett IP, LLC

(57) ABSTRACT

A prefabricated sheet of foldable material to construct a container having one of multiple selectable dimensions, including a perforated pattern to permit separation and discarding of selectable portions and folding of a remaining portion into the container. The perforated pattern may include diagonal lines to provide triangular-shaped portions to overlap and secure to side-walls of the container.

8 Claims, 14 Drawing Sheets

1200

| Caliper | Actual Caliper | Basis Weight | MD Stiffness | CD Stiffness |
|---|---|---|---|---|
| .010 | .010 | 37.9 | 44 | 19 |
| .012 | .013 | 46.5 | 113 | 48 |
| .014 | .015 | 49.6 | 149 | 65 |
| .016 | .016 | 53.7 | 192 | 86 |
| .018 | .019 | 60.4 | 244 | 108 |
| .020 | .0209 | 65.5 | 407 | 177 |
| .022 | .022 | 69.6 | 493 | 208 |
| .024 | .024 | 79.4 | 530 | 212 |

FIG. 12

PRE-FABRICATED TEMPLATES TO CONSTRUCT VARIABLE-DIMENSIONED CONTAINERS

RELATED APPLICATIONS

This application claims the benefit of U.S. Provisional Patent Application No. 61/485,823, filed May 13, 2011.

BACKGROUND

Techniques of constructing variable-size boxes are taught in:

U.S. Pat. No. 6,394,336, to Beneroff et al.;
U.S. Pat. No. 3,598,303, to Folz;
U.S. Pat. No. 4,763,831, to Huang et al.;
U.S. Pat. No. 6,138,901, to Kim et al.;
U.S. Pat. No. 7,070,089, to Kim et al.;
U.S. Pat. No. 6,364,199, to Rose; and
U.S. Pat. No. 4,452,367, to Wein.

BRIEF DESCRIPTION OF THE DRAWINGS/FIGURES

FIG. 12 is a table of specifications for which an example kraft paperboard is available.

Figure 1:
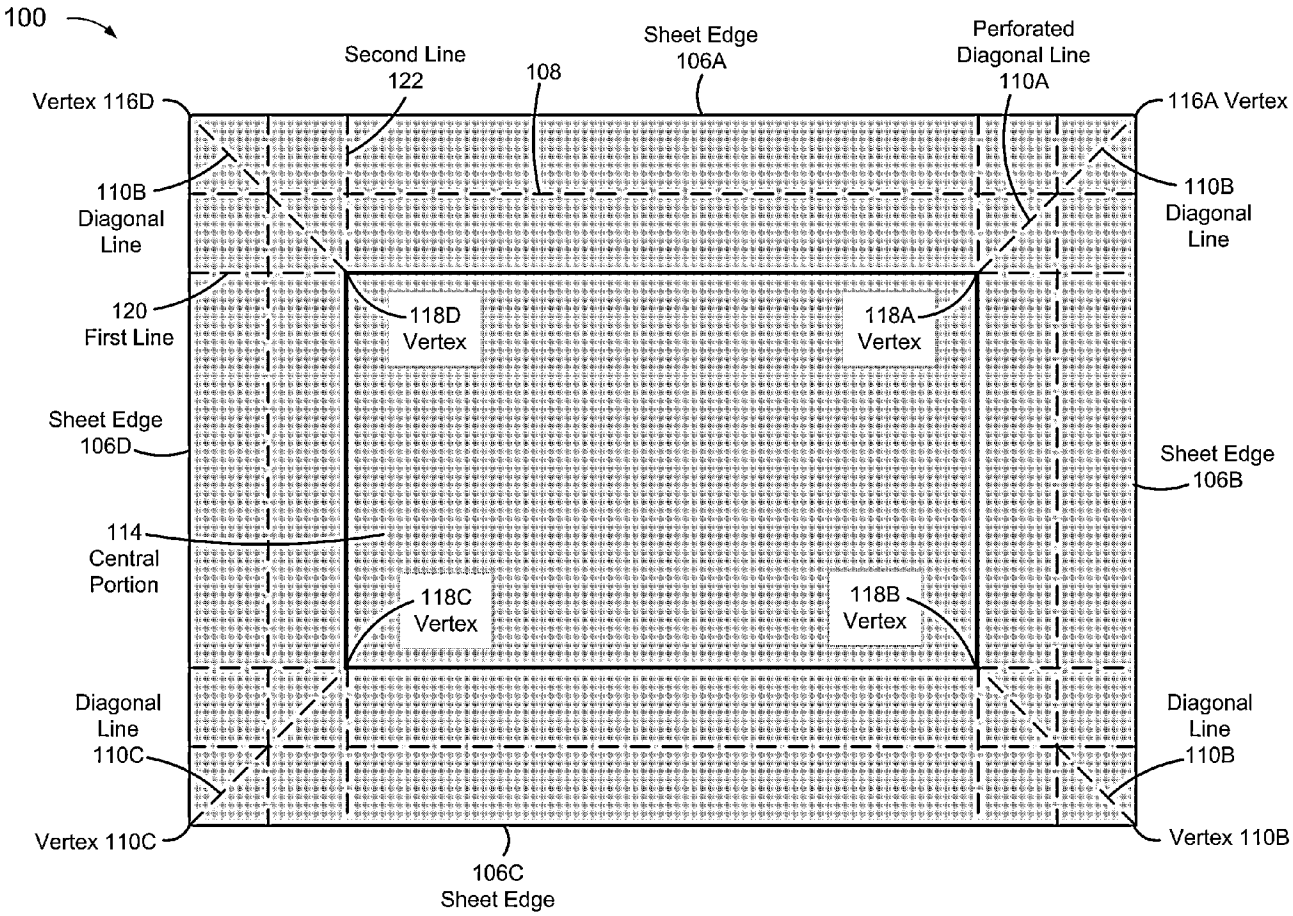
FIG. 1 is a depiction of a sheet of a foldable material, including a pattern of parallel, perpendicular, and diagonal lines perforated through a surface thereof, to facilitate removal of selectable portions of the sheet and folding of a remaining portion of the sheet into a container having one of multiple selectable dimensions.

In the drawings, the leftmost digit(s) of a reference number identifies the drawing in which the reference number first appears.

DETAILED DESCRIPTION

Disclosed herein are methods and systems to provide a sheet of a foldable material with a pattern of perforations, or holes, through a surface thereof, including parallel, perpendicular, and diagonal lines to facilitate removal of selectable portions of the sheet and folding of a remaining portion of the sheet into a container having one of multiple selectable dimensions.

A polygon is a flat or planar shape or figure, formed with a sequence of straight line segments joined at vertices to form a closed path or body. An n-gon is a polygon with n sides. A rectangle, such as a square, is a 4-sided polygon having parallel opposing edges and perpendicular adjacent edges.

The straight line segments of a polygon are referred herein as edges, and a point where two edges meet is referred to herein as a vertex.

A diagonal line that is neither parallel to, nor perpendicular to a reference line.

Where a scaled-down version of a first polygon is centered within the first polygon, the scaled-down version of the first polygon is concentric within the first polygon.

FIG. 1 is a depiction of a sheet 100 of a foldable material, including a pattern of parallel, perpendicular, and diagonal lines perforated through a surface thereof, to facilitate removal of selectable portions of the sheet and folding of a remaining portion of the sheet into a container having one of multiple selectable dimensions.

Edges 106 of sheet 100 form a polygon, illustrated here as a rectangle. Methods and systems disclosed herein are not, however, limited to rectangles.

The perforated pattern includes a first polygon 108, similar to the shape of sheet 100, and concentric within edges 106 of sheet 100.

Sheet 100 further includes a central portion 114 having a shape of sheet 100 and concentric within the first instance 108 of the polygon.

The perforated pattern further includes, for each vertex 116 of sheet 100, a diagonal line 110 from vertex 116 to a corresponding vertex 118 of central portion 114.

The perforated pattern further includes, for each vertex 118 of central portion 114, and for each vertex of polygon 108, a set of first and second lines from the vertex to corresponding first and second edges of sheet 100 that are adjacent to a corresponding vertex 116 of sheet 100. For example, in FIG. 1 the pattern includes a first line 120 from vertex 118D to edge 106D, and a second line 122 from vertex 118D to edge 106A. In the example of FIG. 1, first line 120 and second line 122 are perpendicular to one another and perpendicular to corresponding edges 106D and 106A.

The perforated pattern may include multiple polygons, each nested within another, such as described below with reference to FIG. 2.

Figure 2:
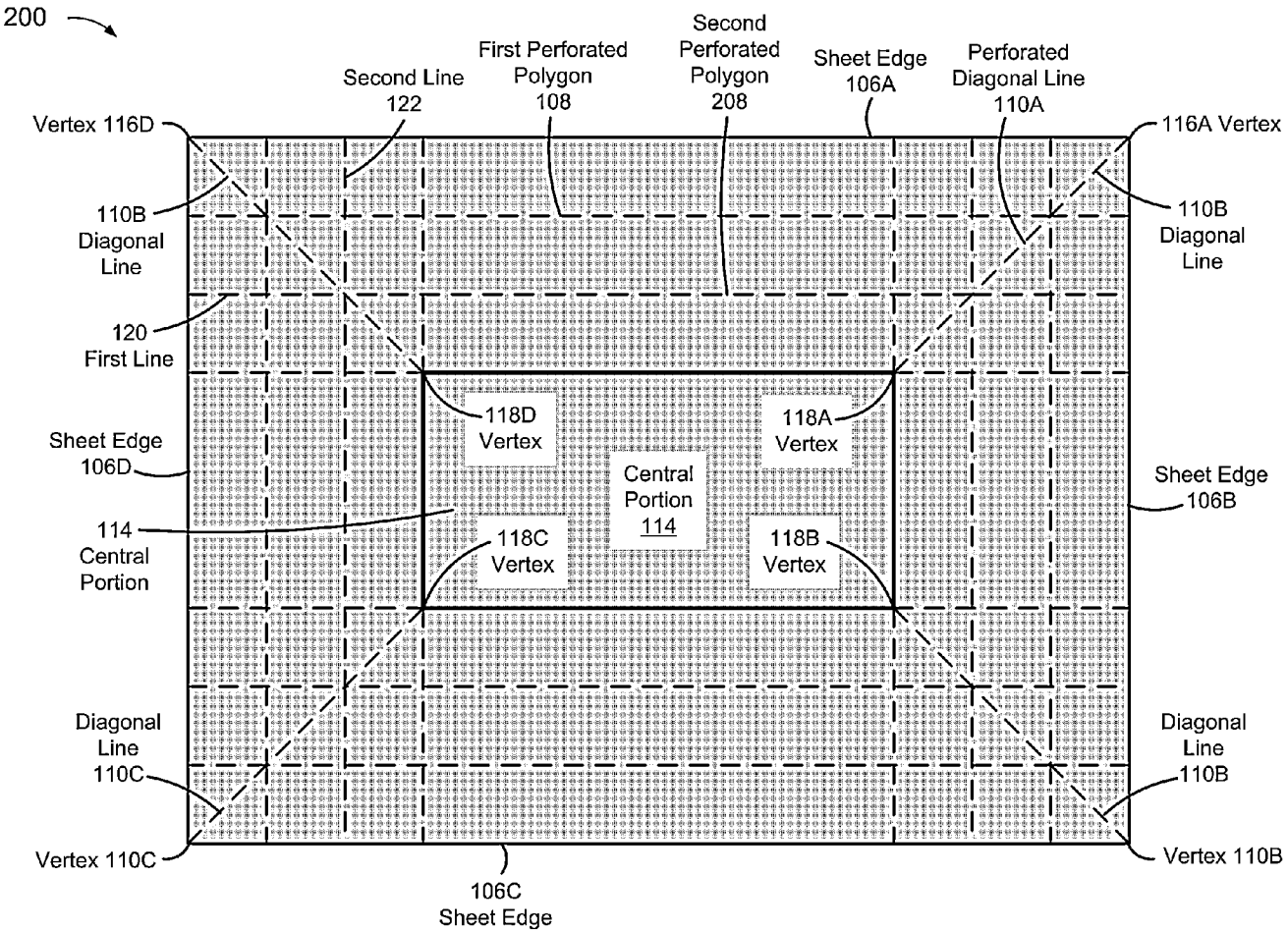
FIG. 2 is a depiction of another sheet of a foldable material, including features described above with reference to FIG. 1, where the perforated pattern further includes multiple perforated polygons.

FIG. 2 is a depiction of a sheet 200 of a foldable material, including features described above with reference to FIG. 1, where the perforated pattern further includes a second polygon 208, similar to and concentric within polygon 108. In FIG. 2, central portion 114 is concentric within polygon 208.

Diagonal lines 110 of the perforated patterns of FIGS. 1 and 2 facilitate removal of selectable portions of a sheet, and folding of a remaining portion of the sheet into a container having one of multiple selectable dimensions, such as described with reference to one or more of FIGS. 3 through 9.

Figure 3:
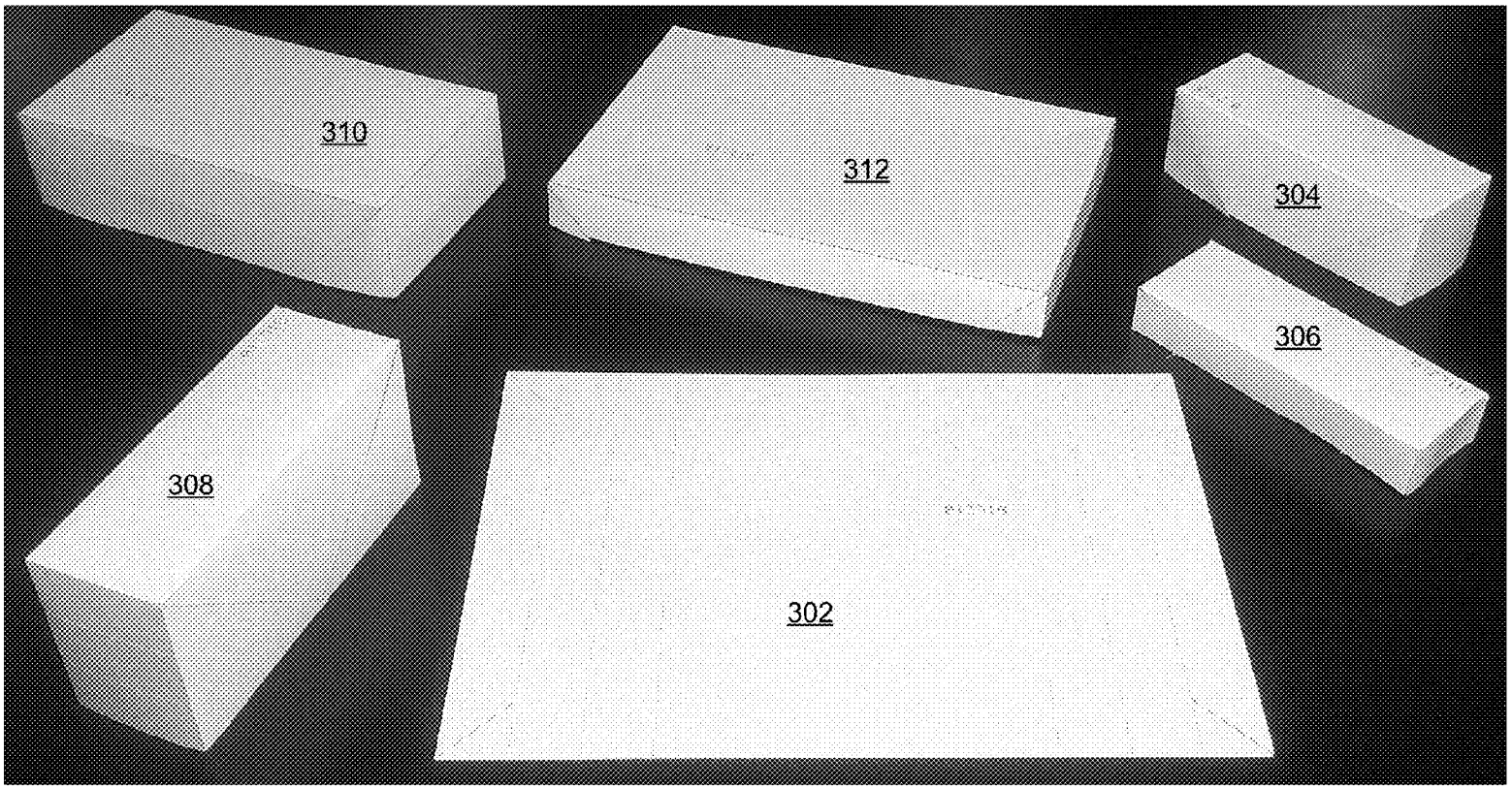
FIG. 3 is an image of another sheet of a foldable material having the perforated pattern of FIG. 2, and of containers that may be constructed from the sheet.

FIG. 3 is an image of a sheet 302 of a foldable material having the perforated pattern of sheet 200. FIG. 3 further includes containers, 304 through 312 that may be constructed from sheet 302. Construction of containers 304 through 308 are described below with reference to FIGS. 4 through 10.

Figure 4:
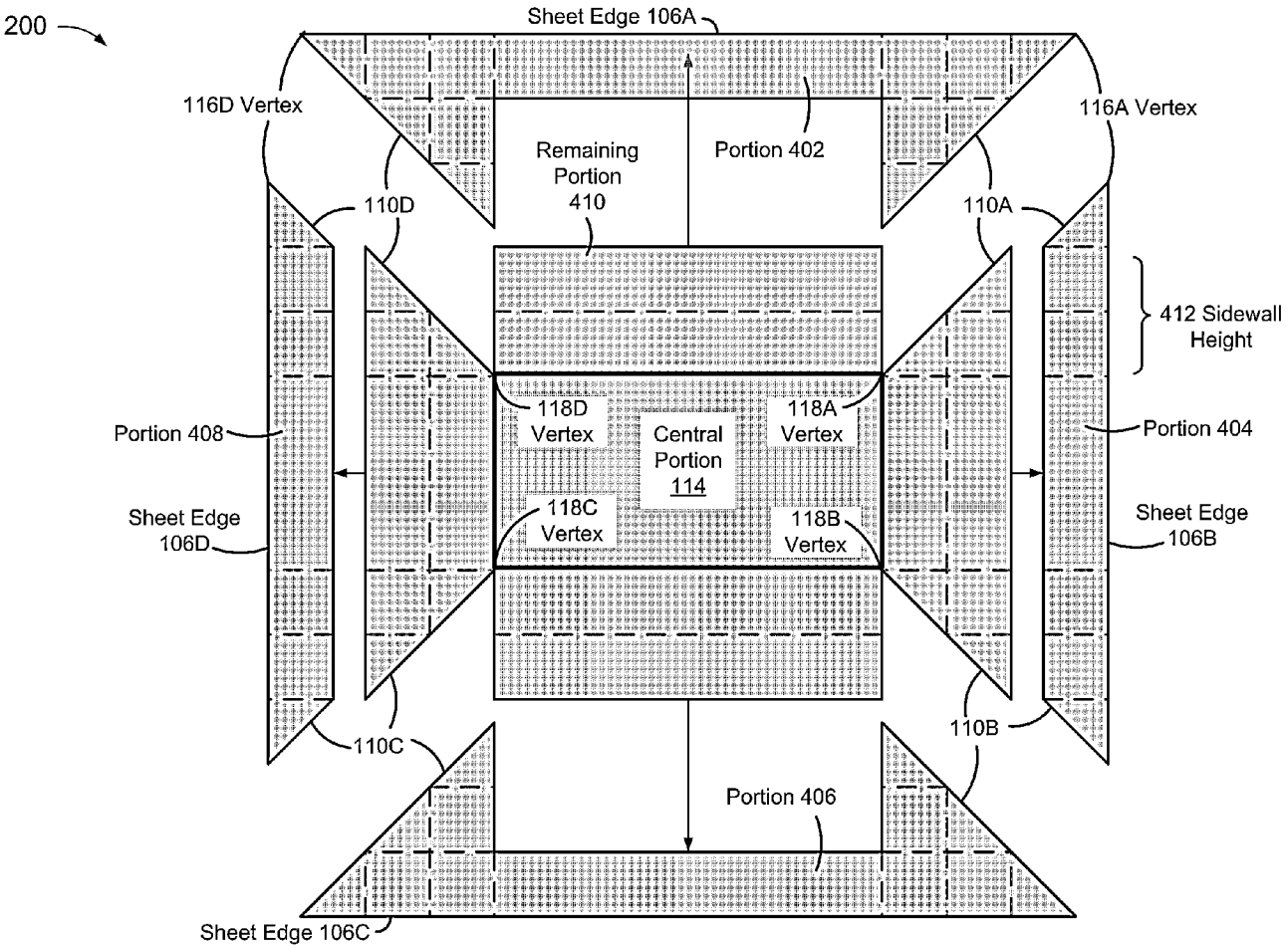
FIG. 4 is another depiction of the sheet of FIG. 2, with portions separated from a remaining portion along diagonal lines and edges of a perforated polygon.

FIG. 4 is a depiction of sheet 200, with portions 402, 404, 406, and 408 separated from a remaining portion 410 along diagonal lines 110 and edges of first polygon 108 (FIGS. 1 and 2). Remaining portion 412 may be folded into container 304 in FIG. 3, to have a base area defined by dimensions of central portion 114, and a sidewall height 412.

Diagonal lines 110 (FIGS. 1 and 2), further facilitate separation of a sheet to provide triangular-shaped portions to overlap side-walls of the first container, such as described below with reference to FIGS. 5 and 6.

Figure 5:
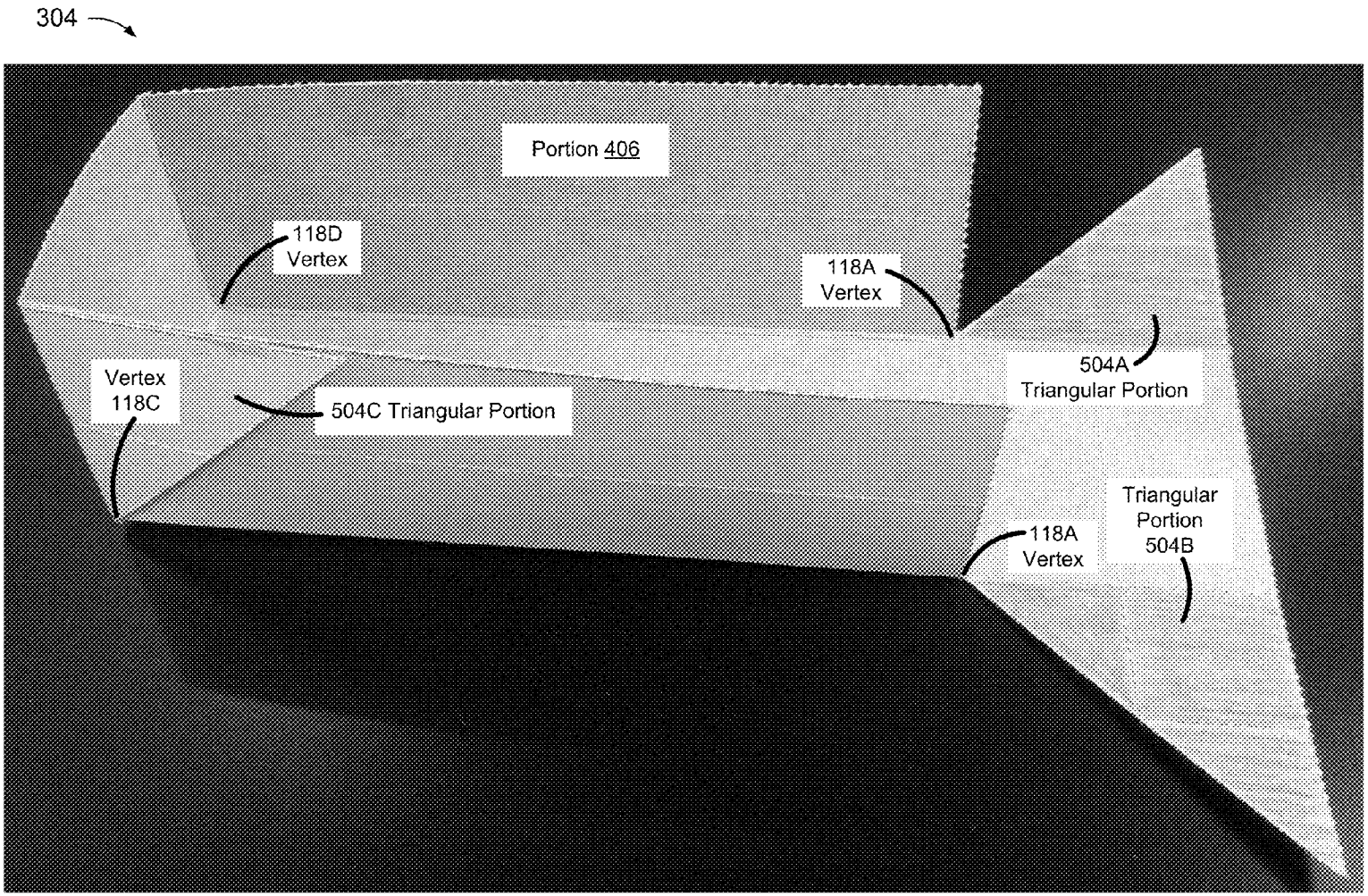
FIG. 5 is an image of a partially constructed container of FIG. 3, including triangular portions to overlap side-walls of the container.
Figure 6:
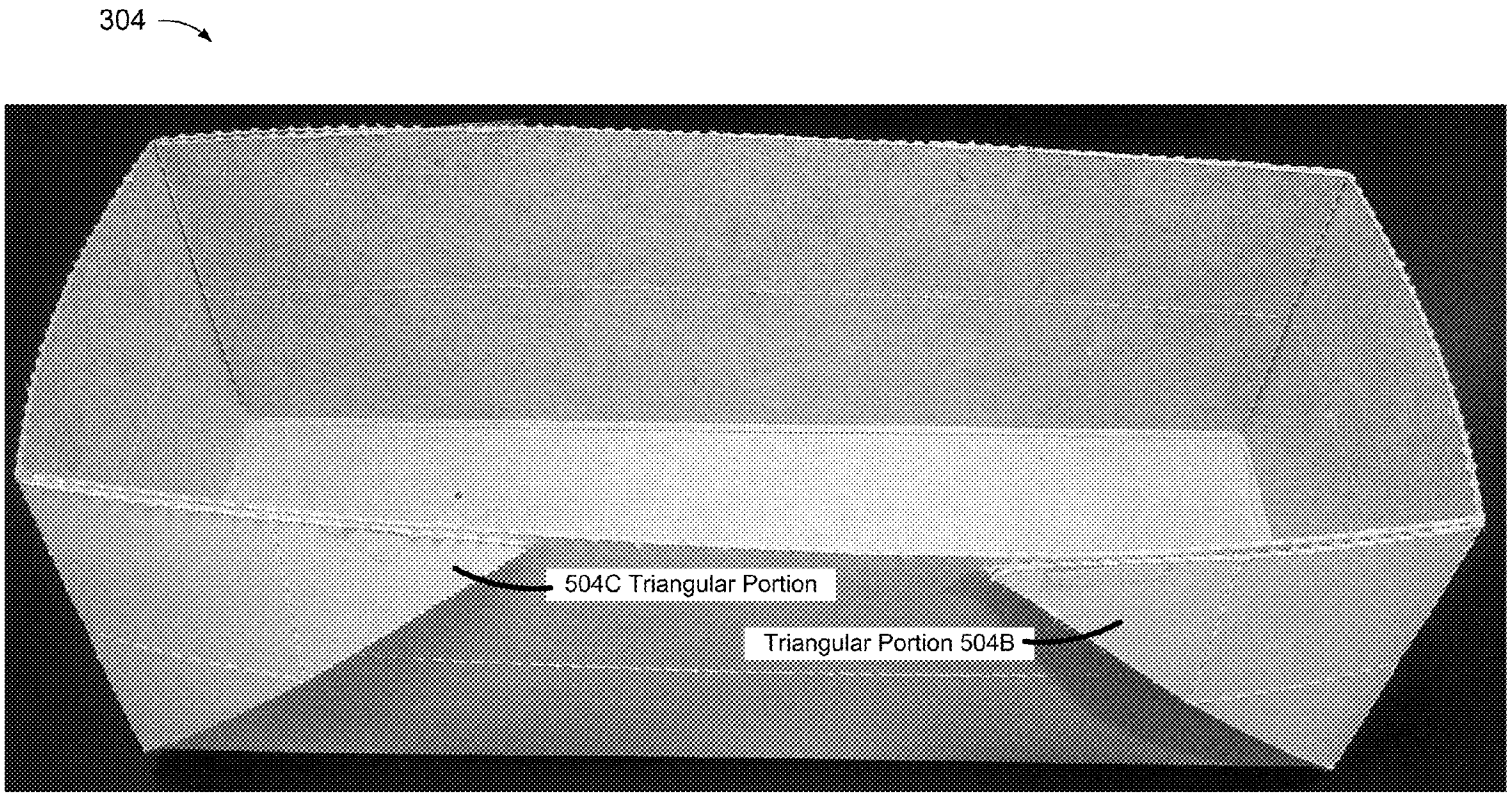
FIG. 6 is another image of the container of FIG. 5.

FIG. 5 is an image of a partially constructed container 304, including triangular portions 504 to overlap side-walls of container 304. FIG. 6 is another image of container 304.

A perforated pattern may be implemented to defines or provide multiple selectable dimensions of the triangular-shaped portions. Each selectable dimension of the triangular-shaped portions may correspond to one of the multiple selectable dimensions of a container.

A sheet of a foldable material having a perforated pattern as disclosed herein may include pre-attached fasteners to secure the triangular-shaped portions to side-walls of corresponding containers, for each of the multiple selectable dimensions of the containers.

The pre-attached fasteners may include adhesive tape such as described below with reference to FIG. 14.

The pre-attached fasteners may include a plurality of tabs and corresponding openings formed through a surface of the sheet. The openings may be dimensioned to receive the tabs, and the tabs may be dimensioned to lockingly engage the sheet when inserted through the openings.

Figure 7:
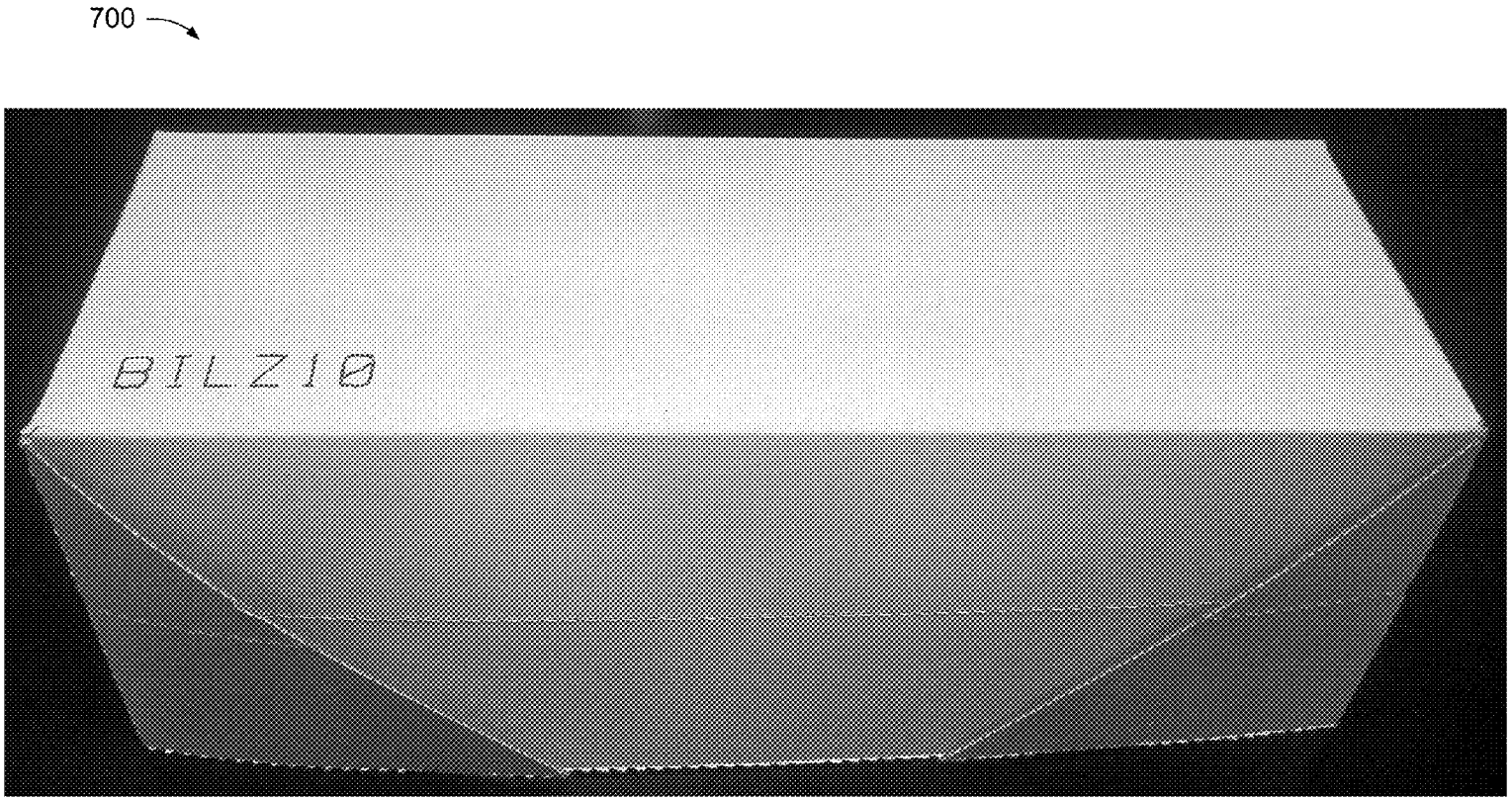
FIG. 7 is an image of another container to enclose the container of FIGS. 5 and 6.

First and second sheets of the foldable material may be provided with similar perforation patterns, but with slightly different dimensions, provide first and second containers, one of which is dimensioned to enclose the other as a cover or lid. For example, FIG. 7 is an image of a container 700 formed from a portion similar to portion 410 in FIG. 4. Container 700 may serve as a lid to enclose container 304.

Figure 8:
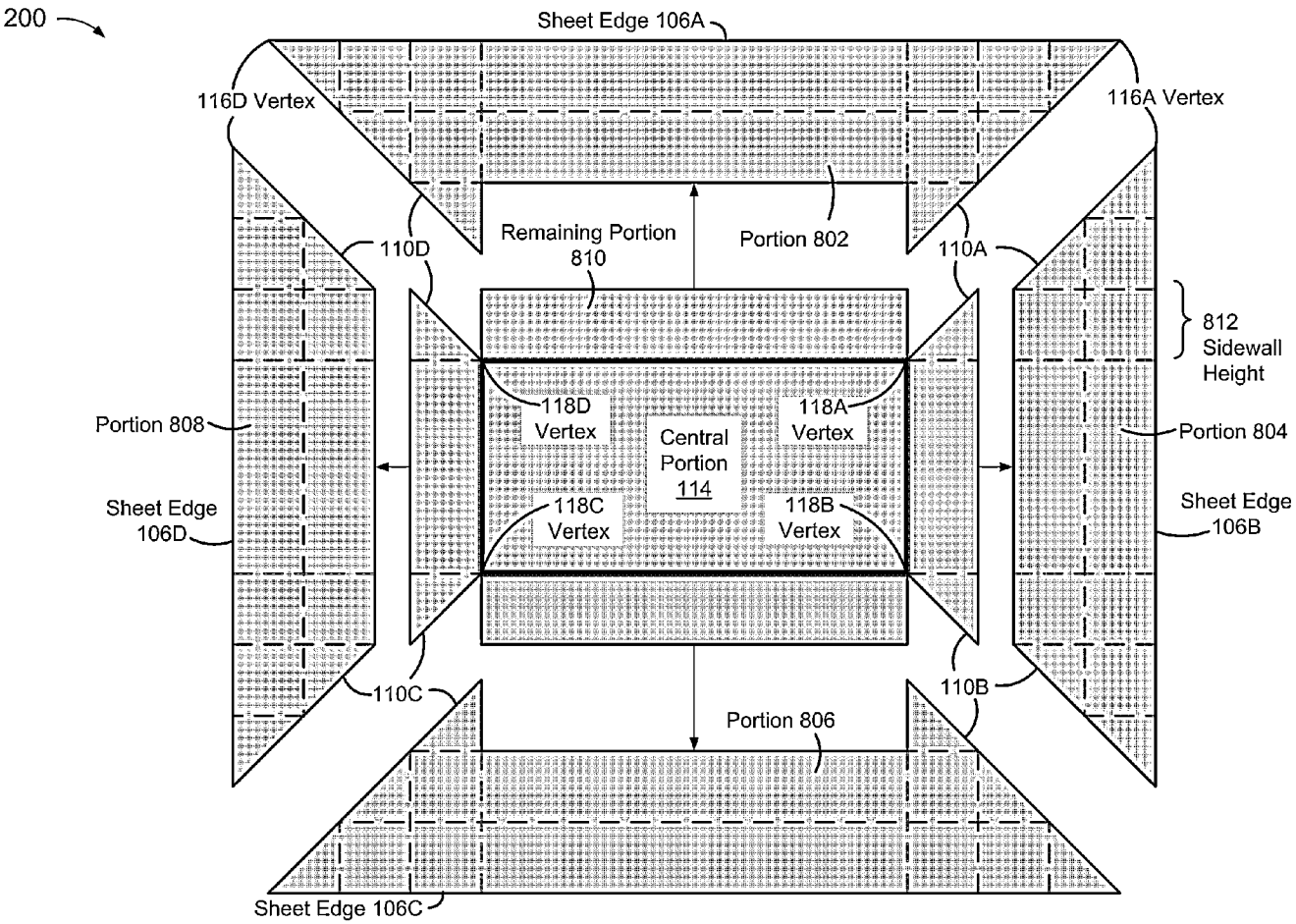
FIG. 8 is another depiction of the sheet of FIG. 2, with portions separated from a remaining portion along diagonal lines and edges of a second polygon to form a container of different dimensions relative to FIG. 4.

FIG. 8 is a depiction of sheet 200, with portions 802, 804, 806, and 808 separated from a remaining portion 810 along diagonal lines 110 and edges of second polygon 208 (FIG. 2). Remaining portion 810 may be folded into container 306 of FIG. 3, to have a base area defined by dimensions of second polygon 208, and a sidewall height 812.

Figure 9:
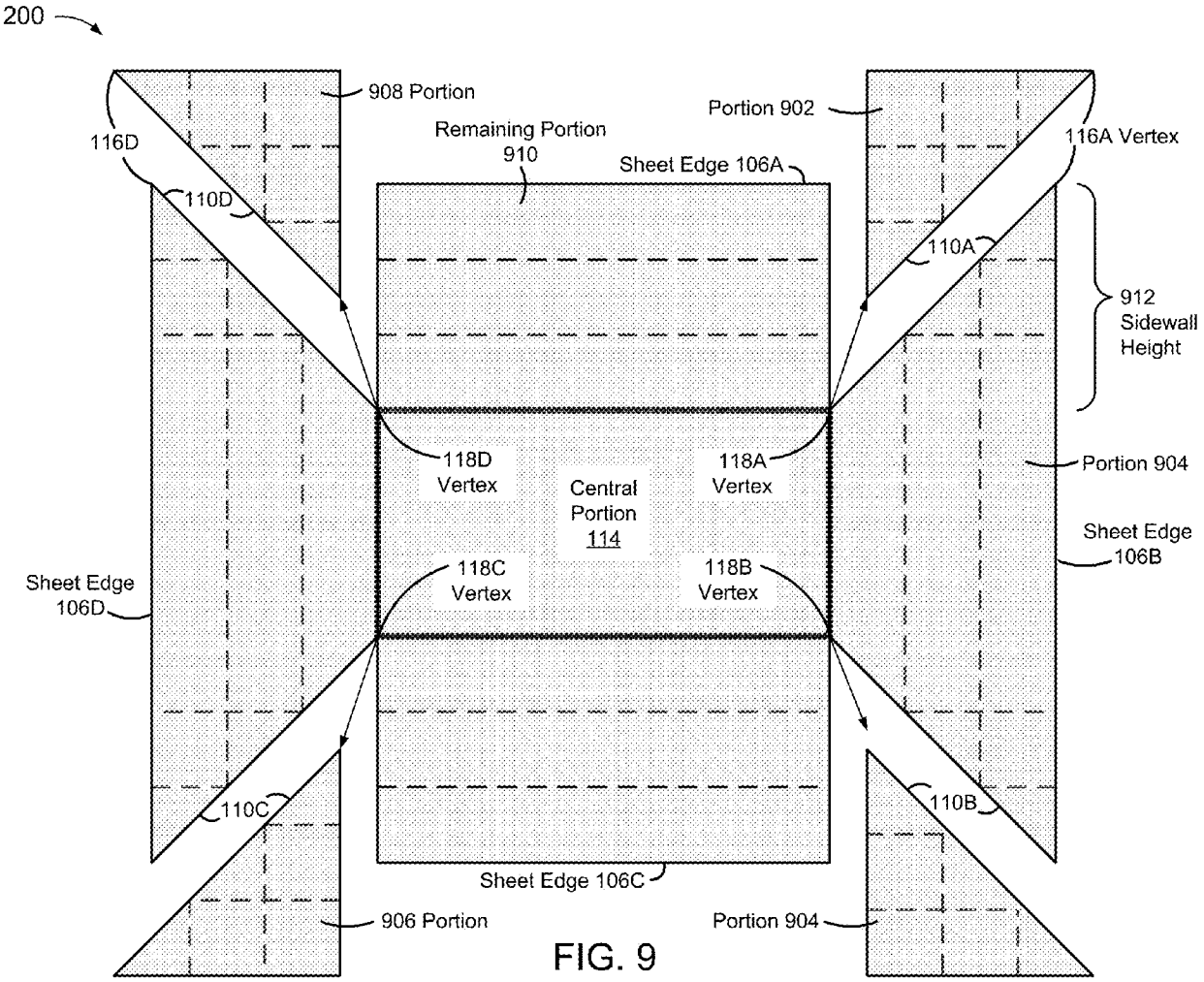
FIG. 9 is another depiction of the sheet of FIG. 2, with portions separated from a remaining portion along diagonal lines to form a container of different dimensions relative to FIGS. 4 and 8.

FIG. 9 is a depiction of sheet 200, with portions 902, 904, 906, and 908 separated from a remaining portion 910 along diagonal lines 110. Remaining portion 910 may be folded into container 308 in FIG. 3, to have a base area defined by dimensions of central portion 114, and a sidewall height 912.

Figure 10:
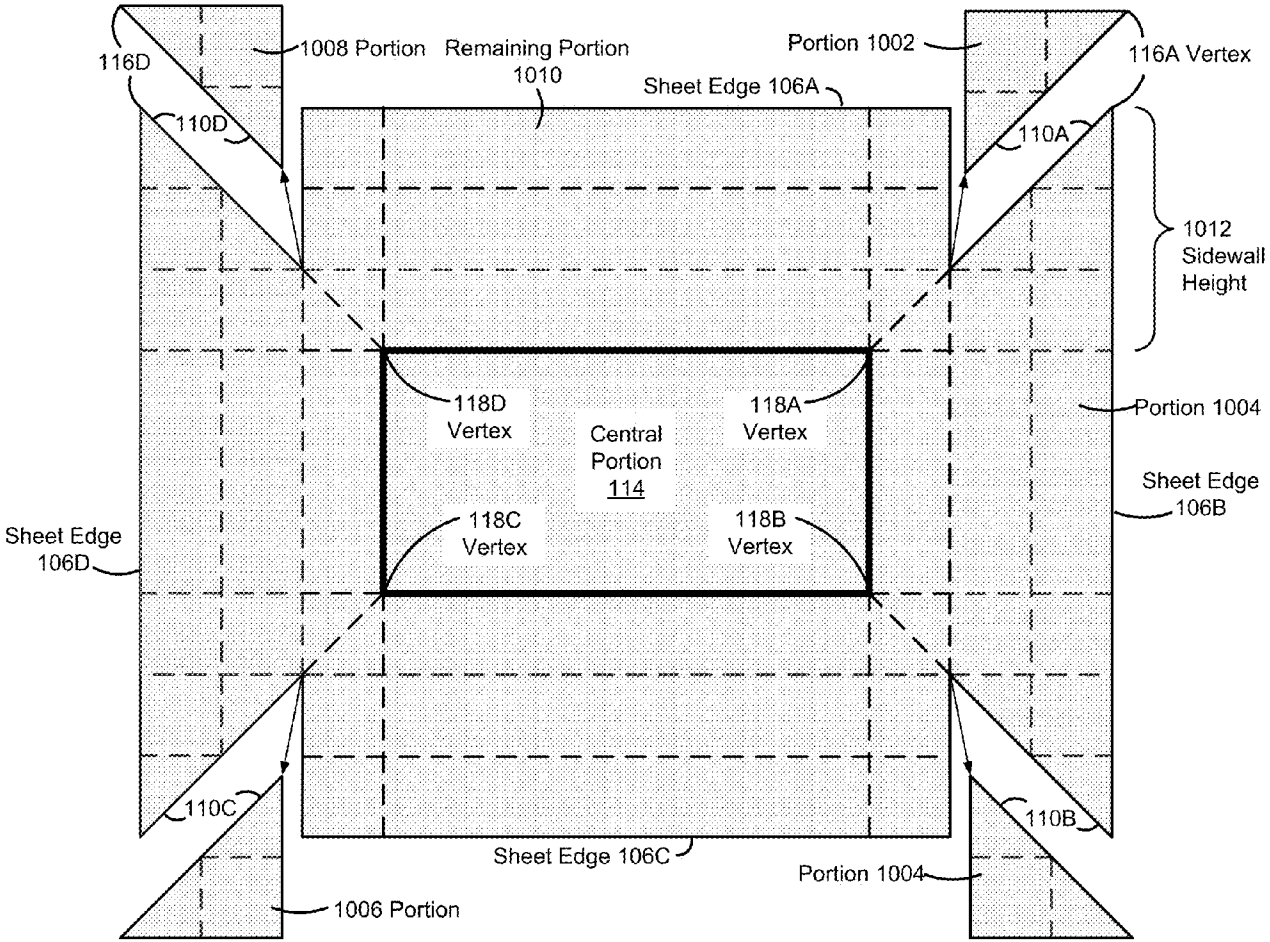
FIG. 10 is another depiction of the sheet of FIG. 2, with portions separated from a remaining portion along diagonal lines to form a container of different dimensions relative to FIGS. 4, 8, and 9.

FIG. 10 is a depiction of sheet 200, with portions 1002, 1004, 1006, and 1008 separated from a remaining portion 1010 along diagonal lines 110. Remaining portion 1010 may be folded into container 310 of FIG. 3, to have a base area defined by dimensions of second polygon 208, and a sidewall height 1012.

As disclosed herein, a base area and depth of a container may be selectable from amongst multiple nested polygon shapes. The multiple selectable dimensions may include multiple base areas and multiple side-wall heights. Each of the base areas may be selectable in combination with each of the side-wall heights.

Figure 11:
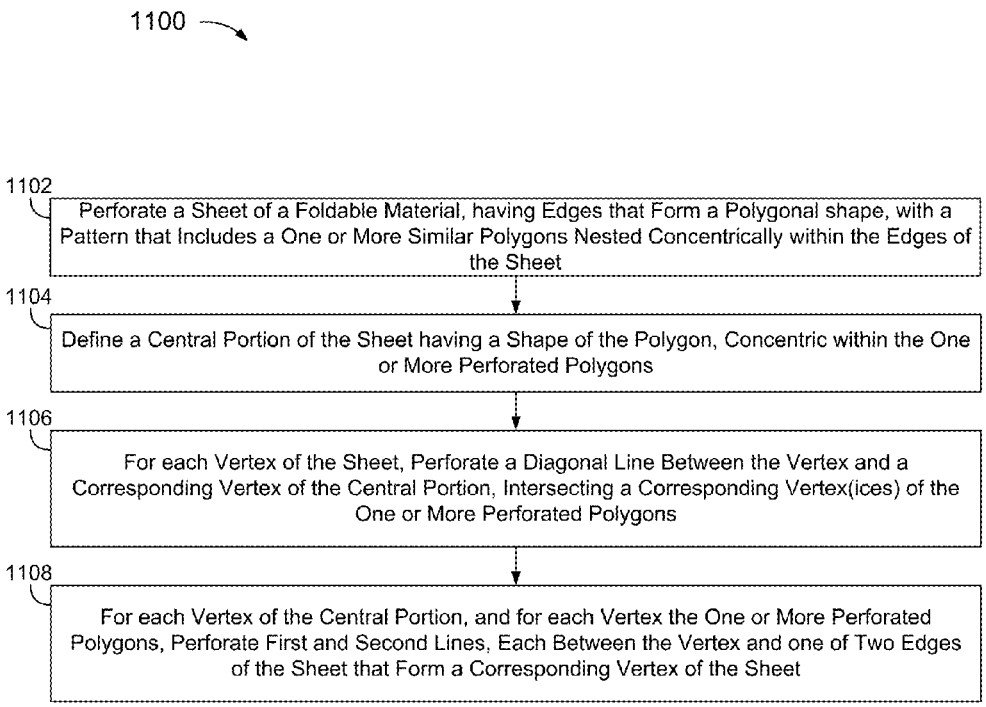
FIG. 11 is a flowchart of a method of providing a sheet of a foldable material with a pattern of parallel, perpendicular, and diagonal lines perforated through a surface thereof, to facilitate removal of selectable portions of the sheet and folding of a remaining portion of the sheet into a container having one of multiple selectable dimensions.

FIG. 11 is a flowchart of a method 1100 of providing a sheet of a foldable material with a pattern of parallel, perpendicular, and diagonal lines perforated through a surface thereof, to facilitate removal of selectable portions of the sheet and folding of a remaining portion of the sheet into a container having one of multiple selectable dimensions.

At 1102, a sheet of a foldable material, having edges that form a polygon, is perforated with a pattern that includes a polygon similar to the shape of the sheet, concentric within the edges of the sheet. The pattern may include one or more additional polygons, each nested within and concentric with another one of the polygons.

At 1104, a central portion of the sheet is defined as a polygon similar to the shape of the sheet, concentric within the one or more perforated polygons.

At 1106, for each vertex formed by adjacent edges of the sheet, a diagonal line is perforated between the vertex to a corresponding vertex of the central portion, intersecting corresponding vertices of the one or more perforated polygons.

At 1108, for each vertex of the central portion, and for each vertex of the one or more perforated polygons, a set of first and second lines are perforated from the vertex to corresponding first and second adjacent edges of the sheet, such as perforated lines 120 and 122 in FIGS. 1 and 2.

Methods and systems disclosed herein may be implemented with, for example and without limitation, paperboard, container board (e.g., corrugated cardboard), folding boxboard (FBB), kraft-based board, solid bleached board (SBB) or solid bleached sulphate (SBS), and/or solid unbleached board (SUB).

Paperboard is a relatively paper based material having thickness greater than that of typical paper, which may be greater than 0.25 mm, 0.010 inches, or 10 points. Paperboard may include a paper having a basis weight (grammage) above 224 g/meter$^2$, and may be single or multi-ply.

Folding boxboard includes multiple layers of chemical and/or mechanical pulp, and may include mechanical pulp between two layers of chemical pulp. A top layer may include bleached chemical pulp, and may include a pigment coating. FBB is a relatively low density material with relatively high stiffness.

Kraft processing, also known as kraft pulping and sulfate processing, a technology for conversion of wood into wood pulp, most of which may include almost pure cellulose fibers.

Solid bleached board or solid bleached sulphate is a virgin fiber grade of paperboard made from bleached chemical pulp. A surface of one or more layers may be coated with a mineral or synthetic pigment.

Solid unbleached paperboard may be manufactured from unbleached chemical pulp, and may include one or more layers of mineral or synthetic pigment coating. Recycled fibers may be used in place of unbleached chemical pulp.

In an embodiment, methods and apparatuses disclosed herein are implemented with a food-grade, coated, and unbleached kraft paperboard manufactured from *eucalyptus* fiber, such as a that available from MeadWestvaco Corporation, of Glen Allen, Va., under the trade name KlaFold®. Such a paperboard is hygienic with substantially no smell or taste, and is thus suitable for packaging aroma-sensitive and flavor-sensitive products such as, for example, chocolate, tobacco, and cosmetics. In addition, perforations may be less visible relative to other types of paperboard.

FIG. 12 is a table 1200 of specifications for which KlaFold® paperboard is available. Methods and apparatuses disclosed herein may be implemented in accordance with one or more specifications provided in FIG. 12.

Figure 13:
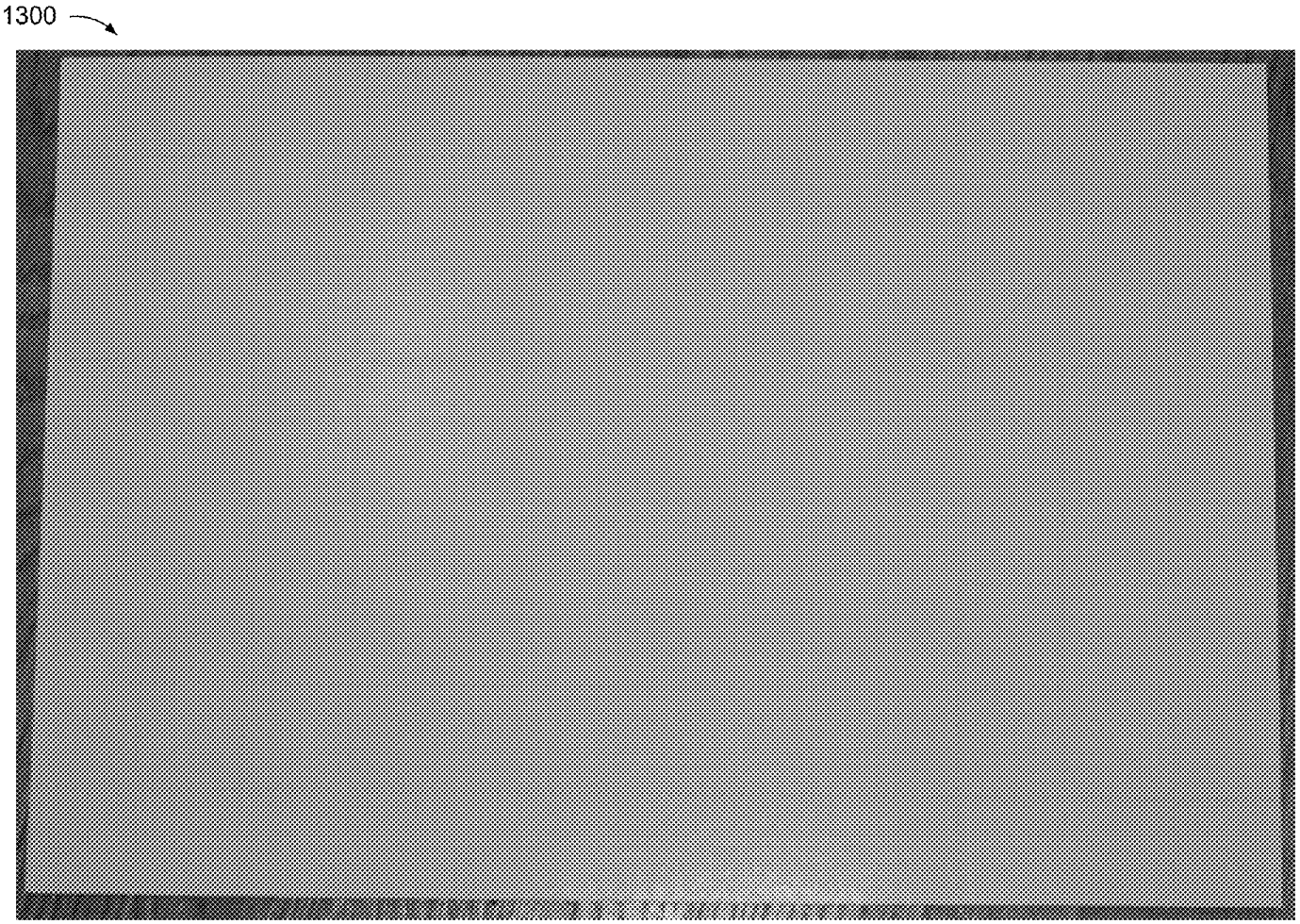
FIG. 13 is an image of a sheet of a kraft paperboard, manufactured from *eucalyptus* fiber, including a pattern of perforated lines, such as described in one or more examples above.

FIG. 13 is an image of a sheet 1300 of KlaFold® paperboard, including a pattern of perforated lines, such as described in one or more examples above.

Figure 14:
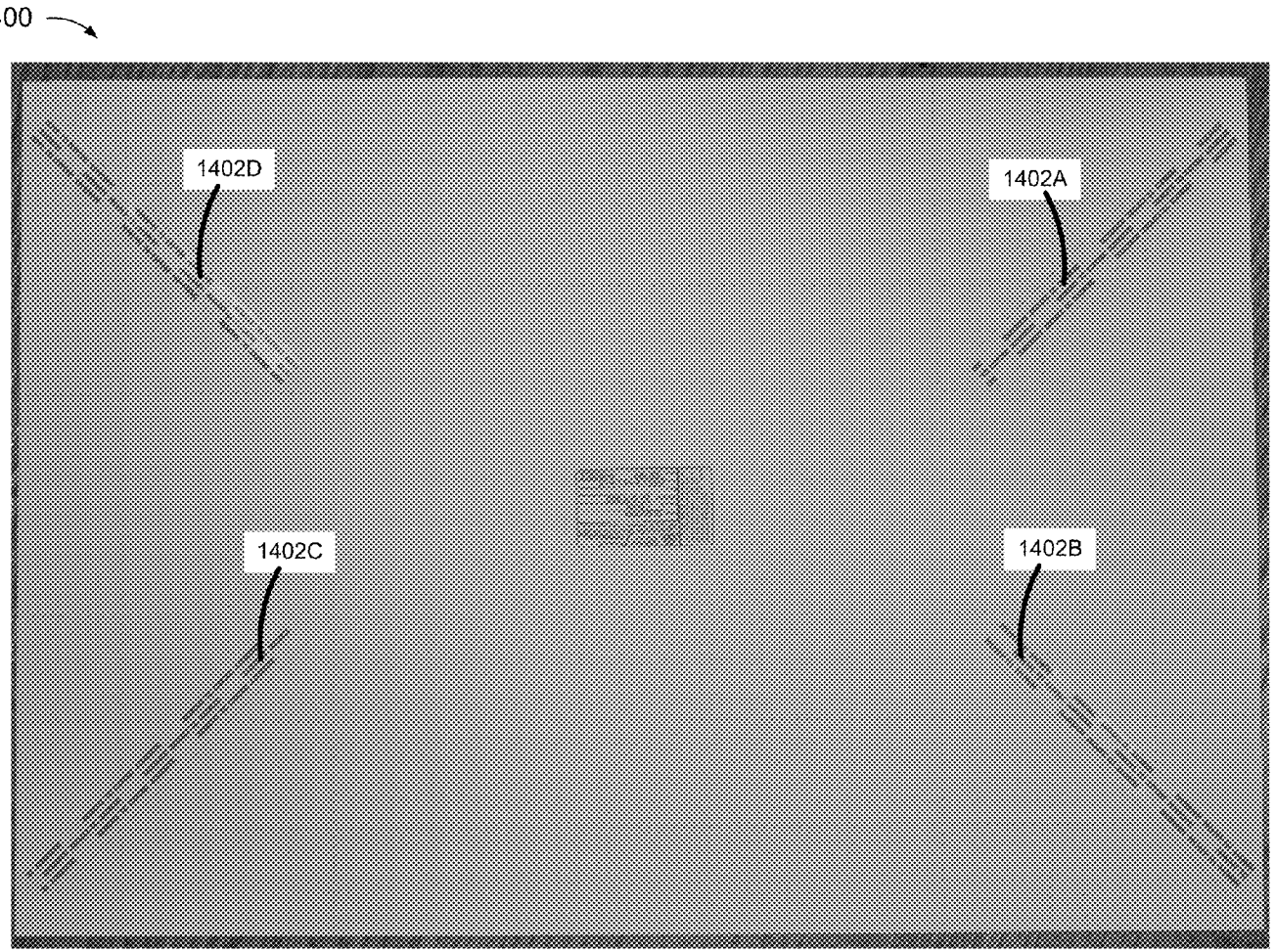
FIG. 14 is an image of a sheet having a pattern of perforated lines, including adhesive tape to secure triangular-shaped portions of the sheet to side-walls of a container formed from the sheet.

FIG. 14 is an image of a sheet 1400 including a pattern of perforated lines, such as described in one or more examples above, and further including adhesive tape 1402 to secure triangular-shaped portions of sheet 1400 to side-walls of a container formed from sheet 1400. Adhesive tape 1402 includes a first adhesive surface affixed or secured to an underside surface of sheet 1300, a second adhesive surface opposite the first adhesive surface, and a removable tab that covers the second adhesive surface.

Methods and systems are disclosed herein with the aid of functional building blocks illustrating the functions, features, and relationships thereof. At least some of the boundaries of these functional building blocks have been arbitrarily defined herein for the convenience of the description. Alternate boundaries may be defined so long as the specified functions and relationships thereof are appropriately performed.

While various embodiments are disclosed herein, it should be understood that they have been presented by way of example only, and not limitation. It will be apparent to persons skilled in the relevant art that various changes in form and detail may be made therein without departing from the spirit and scope of the methods and systems disclosed herein. Thus, the breadth and scope of the claims should not be limited by any of the example embodiments disclosed herein.

What is claimed is:

1. An apparatus, comprising:

a sheet of a foldable material having edges that form a polygonal shape, a central portion having the polygonal shape concentric within the sheet, and a pattern of perforations through a surface of the sheet, wherein the pattern of perforations includes, a first polygon having the polygonal shape of the sheet, concentric within the edges of the sheet, multiple diagonal lines, wherein each diagonal line extends linearly between a respective vertex of the central portion of the sheet and a corresponding vertex of the sheet, and a set of first and second lines for each vertex of the central portion of the sheet and for each vertex of the first polygon, wherein each of the first lines extends from the respective vertex to an edge of the sheet that is adjacent to a corresponding vertex of the sheet, and wherein each of the second lines extend from the corresponding vertex to another edge of the sheet that is adjacent to the corresponding vertex of the sheet;

wherein the pattern of perforations defines multiple selectable removable portions of the sheet and multiple corresponding selectable remaining portions of the sheet;

wherein each selectable remaining portion of the sheet is configurable as a respective container having a corresponding one of multiple dimensions; and wherein each selectable remaining portion of the sheet includes triangular-shaped portions to overlap side-walls of the respective container.

2. The apparatus of claim 1, wherein the pattern of perforations further includes:

one or more additional polygons having the polygonal shape of the sheet, concentrically nested within the first polygon; and an additional set of the first and second lines for each vertex of the one or more additional polygons;

wherein the multiple diagonal lines that extend from the vertexes of the central portion to respective vertexes of the sheet formed by adjacent edges of the sheet, intersect corresponding vertices of the first polygon and the one or more additional polygons.

3. The apparatus of claim 1, wherein the pattern of perforations defines multiple selectable dimensions of the triangular-shaped portions, and wherein each selectable dimension of the triangular-shaped portions corresponds to a respective one of the selectable dimensions of the container.

4. The apparatus of claim 1, wherein each selectable remaining portion of the sheet includes fasteners to secure the respective triangular-shaped portions to the side-walls of the respective container.

5. The apparatus of claim 4, wherein the fasteners include segments of adhesive tape, each of which includes:

a first adhesive surface secured to a surface of the sheet adjacent to and parallel with one of the diagonal lines;

a second adhesive surface to secure a triangular-shaped portion of the respective selectable remaining portion of the sheet to a side-wall of the respective container; and a removable cover positioned over the second adhesive surface.

6. The apparatus of claim 4, wherein the fasteners of each selectable remaining portion of the sheet include:

a plurality of tabs to lockingly engage with corresponding openings through a surface of the sheet to secure the respective triangular-shaped portions to the side-walls of the respective container.

7. The apparatus of claim 1, wherein the multiple selectable dimensions include multiple base areas and multiple side-wall heights, wherein each of the base areas is selectable in combination with each of the side-wall heights.

8. The apparatus of claim 1, wherein the sheet of the foldable material includes a food-grade paperboard manufactured from *eucalyptus* fiber.

* * * * *